US005156753A

United States Patent [19]

Speidel

[11] Patent Number: 5,156,753

[45] Date of Patent: Oct. 20, 1992

[54] CONCRETE CURB FORM DEVICE

[76] Inventor: Charles M. Speidel, P.O. Box 249, Visalia, Calif. 93279-0249

[21] Appl. No.: 764,225

[22] Filed: Sep. 23, 1991

[51] Int. Cl.[5] ..... B28B 7/06; E01C 7/00

[52] U.S. Cl. ..... 249/5; 249/159; 249/219.1

[58] Field of Search ..... 249/1-5, 249/9, 34, 36, 208, 219.1, 158, 159, 189, 6-8

[56] References Cited

U.S. PATENT DOCUMENTS

| | | | |
|---|---|---|---|
| 1,109,433 | 9/1914 | Leydecker | 249/5 |
| 1,644,586 | 10/1927 | Heltzel | 249/5 |
| 1,770,518 | 7/1930 | Harrold | 249/5 |
| 2,298,837 | 10/1942 | Oswald | 249/34 |
| 3,207,465 | 9/1965 | Papin | 249/5 |

*Primary Examiner*—Jay H. Woo
*Assistant Examiner*—Khanh P. Nguyen
*Attorney, Agent, or Firm*—Jack C. Munro

[57] ABSTRACT

A device for establishing the correct spacing (width and height) between a pair of sheet material elongated form members between which a slurry of concrete is to be poured and, when solidifed, will produce a rigid concrete curb. One form member is to be held in place within a first rigid member with the remaining form member to be held in place by a second rigid member. The first and second rigid members are connected together thereby establishing the width of the resultingly formed curb. Each rigid member includes a pin which is to connect with the inside surface of its respective form member. Once the slurry has been poured between the form members, these pins are to be removed prior to the slurry solidifying. Once the slurry is solidified, the curb form device is to be completely disconnected from the form members with the form members also being separated from the resultingly formed concrete curb.

6 Claims, 1 Drawing Sheet

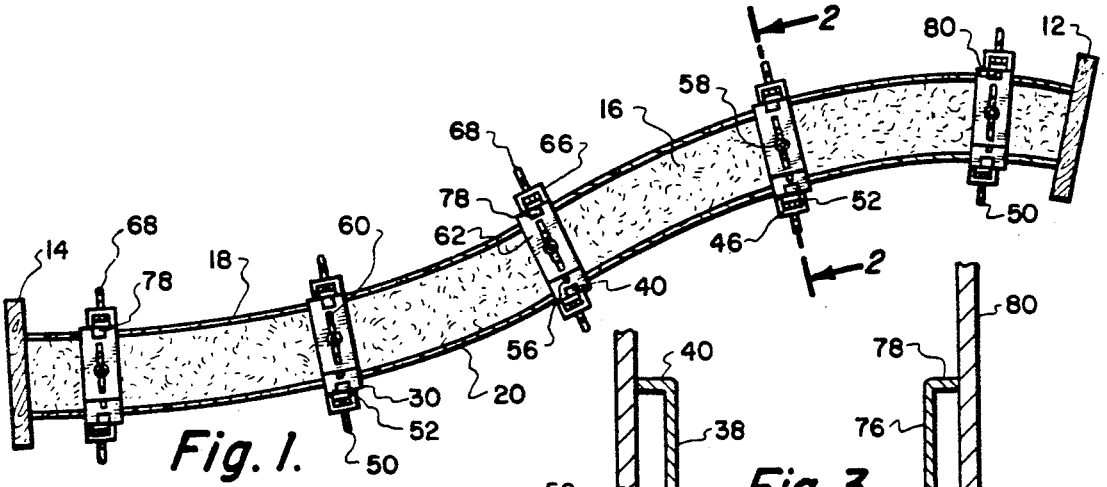
Fig. 1.
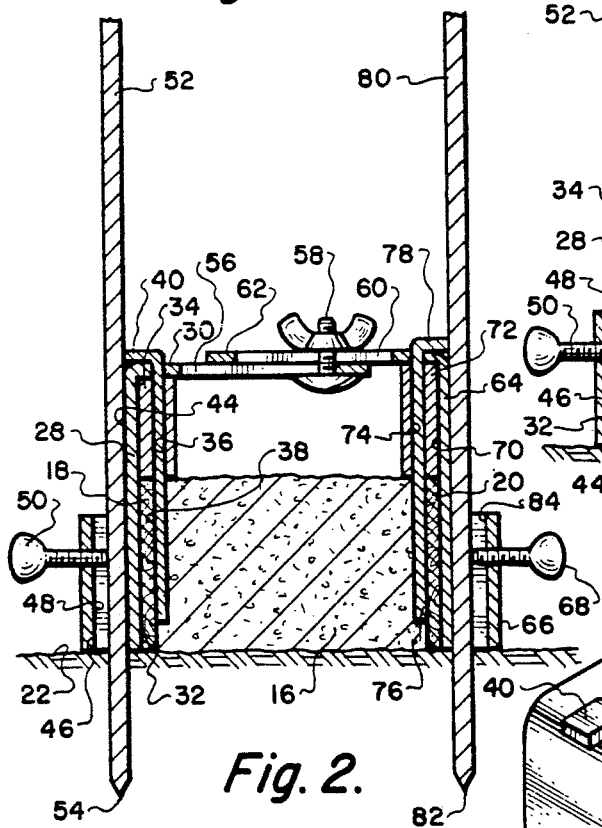
Fig. 2.
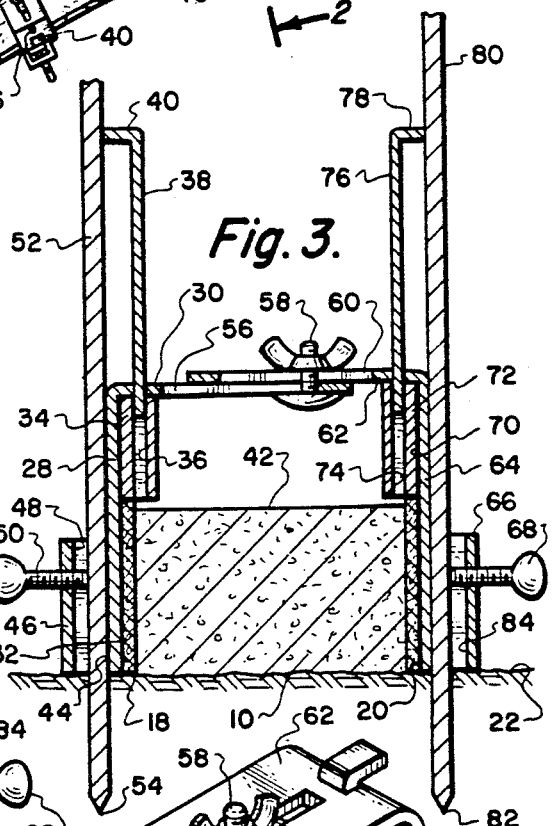
Fig. 3.
Fig.4.

CONCRETE CURB FORM DEVICE

BACKGROUND OF THE INVENTION

1) Field of the Invention

The field of this invention relates to concrete curb forming devices and more particularly to a device which attaches to elongated strip members which are utilized to form the side walls of the curb permitting positioning in unison of the form members at a desired location prior to forming of the curb.

2) Description of Related Art

It is necessary when pouring of a concrete structure on the ground to utilize a rigid member to establish a side wall barrier for the slurry of concrete that is to be poured. Typical rigid members are thin, elongated, wood boards which can be bent somewhat so that the poured concrete will be directed in a given path or assume a particular desired shape. It is common when using of the wood boards to employ stakes on the exterior surface (and sometimes the interior surface) of the boards which are to be penetratingly anchored to the ground.

A concrete curb constitutes a narrow, elongated raised section of concrete which is usually between six inches and twelve inches in width. Generally a curb has parallel side walls and a planer top surface. It is desirable to have the width of this curb be constant and any deviation from a constant width at any point along the length of the curb is readily noticeable. An inconsistent width gives the appearance of substandard workmanship. The curb may be in a straight line or be curved.

When individuals are laying forms for establish of curbing, since there are two form members required located in a spaced apart side-by-side relationship, it becomes a rather time-consuming procedure. There is a need to utilize some type of device which will connect to the elongated, strip, wood form members which will facilitate their replacement and at the same time insure that the form members are precisely spaced apart so that, when the concrete is poured, the resultingly formed concrete curb will have a consistent width and height throughout its entire length.

SUMMARY OF THE INVENTION

The device of the present invention is to be used in conjunction with conventional strips of thin wood or other similar rigid material form members with each form member to form a side wall of the curb this is to be formed. The form members are to be mounted in conjunction with the device and in essence be carried by the device. There will be utilized a plurality of the devices of the present invention usually located only a few feet apart along the entire length of the form members which are to be utilized to form the curb. The device of the present invention is to be adjustable so that the width of the resultingly formed curb can be either increased or decreased according to what width of curb that is desired. Lateral inside support for the form members is provided by a pair of removable pins which are mounted after pouring of the each device. These pins are to be removed after pouring of the concrete slurry but prior to solidifying of the slurry so that the voids which will be created when the pins are removed from the slurry will be eliminated by the flowing of the slurry into the voids. Each device is to be fixed in position on the ground by means of stakes which are to be penetrate the ground.

The primary objective of the present invention is to construct a device to substantially decrease the amount of time that is required to construct the forms for the producing of concrete curbs.

Another objective of the present invention is that by using the device of the present invention to overall width and height of the resultingly formed curb is consistent thereby giving the appearance of good workmanship in conjunction with the producing of the curb by the device of the present invention. Another primary objective of this invention is that if the user wishes to alter the initial set-up such is easily accomplished. Still another main objective of this invention is that it permits the user to easily control long form members during positioning.

BRIEF DESCRIPTION OF THE DRAWING

FIG. 1 is a top plan view of a pair of form members which are supported by the device of the present invention with a concrete slurry having been poured between the form members;

FIG. 2 is a cross-sectional view through one of the devices of the present invention taken along line 2—2 of FIG. 1 with the concrete still being in the slurry state with the lateral support pins of the device in the extended position;

FIG. 3 is a view similar to FIG. 2 but showing the concrete in a hardened state and with the lateral support pins that are utilized in conjunction with the device of this invention being located in the retracted position; and FIG. 4 is a isometric view of the device of the present invention.

DETAILED DESCRIPTION OF THE SHOWN EMBODIMENT

Referring particularly to the drawing there is shown a concrete curb 10 which is terminated at one end by end plate 12 and at the opposite end by end plate 14. The concrete curb 10 is to be initially poured by a slurry 16 which then solidifies forming the curb 10. In order to hold in position slurry 16, there is utilized form members 18 and 20. The form members 18 and 20 are rigid and are normally constructed of wood and are sufficiently thin to be bendable to assume other than a straight configuration such as the arcuate configuration shown in FIG. 1. However, in some installations, the form members 18 and 20 may not be bendable but are rigid. The form members 18 and 20 are basically identical and are to be located in an evenly spaced apart arrangement. The form members 18 and 20 are to normally rest directly on the supporting surface such as the ground 22. However, form member 18 could be nailed by nails (not shown) through holes 31 and be spaced slightly above ground 22. The same is true for form 20 by holes 63.

Supporting laterally the form member 18 on the ground 22 is a first rigid member 24. In a similar manner providing lateral support to the form member 20 is a second rigid member 26. The rigid members 24 and 26 may be constructed of plastic, metal or other similar type of rigid material. The rigid member 24 is L-shaped in configuration forming a vertical leg 28 and a horizontal leg 30. The form member 18 is to be located directly against the interior surface 32 of the vertical leg 28. The upper edge of the form member 18 rests against the bottom edge of a plug 34. The plug 34 includes a through hole 36. A pin 38 is conducted through the hole 36 and is to be locatable against the inside surface of the form member 18 as is shown in FIG. 2 of the drawing. The pin 38 has an outer end formed into a right angled section 40. When end 40 contacts the outside surface of horizontal section 30, the pin 38 is in the extended position. When in this extended position, the pin 38 will be submerged within the slurry 16. The pin 38 is to be removed to the retracted position shown in FIG. 3 which is when the pin 38 is spaced from the slurry 16. The slurry 16 will automatically fill (with minor tapping or vibration) the void created by the pin 38 within the slurry 16. After the pin 38 of the concrete curb 10 is made smooth by a human being skilled in finishing concrete.

The vertical leg 28 has an exterior surface 44. Mounted on the exterior surface 44 is a channel member 46. This channel member 46 has a through opening 48. A threaded bolt 50 is threadably connected to the channel member 46 with the inner end of the bolt 50 connecting with the through opening 48. A rigid stake 52, which has a sharp pointed end 54, is located in through opening 48. This stake 52 is to be forcibly driven by hammer or other similar tool so that the end 54 and a portion of the stake 52 penetrate the ground 22. Once a desirable amount of penetration has been achieved, the bolt 50 is to be tightened so as to press tightly against the 52 stake thereby fixing in position the first rigid member 24 relative to the stake 52.

Horizontal leg 30 includes an elongated slot 56. Connecting with the slot 56 is a bolt fastener 58. The bolt fastener 58 also connects with elongated slot 60 of horizontal leg 62 of the rigid member 26. When the fastener 58 is loosened, it is understood that the horizontal legs 30 and 62 can be slidingly moved relative to each other and thereby provide adjustment therebetween and thereby increase or decrease the width of the form area which will thereby increase or decrease the width of the resultingly formed curb 10.

The rigid member 26 also has a vertical leg 64. The rigid member 26 is basically identical in construction to the rigid member 24. Mounted in conjunction with the rigid member 26 is a channel member 66 and a bolt fastener 68 which operates in the same manner as channel member 46 and bolt fastener 50. Also mounted on the inside surface 70 of the vertical leg 64 is a plug 72 which is basically similar to plug 34. Plug 72 includes a through opening 74 with a pin 76 being engaged therewith. Pin 76 is basically identical to pin 38 with the outer end of pin 76 also formed into a right angled section 78. It is the function of pin 76 to provide lateral support to form member 20.

A stake 80 which has sharp point 82 is to be extended through the through opening 84 which is formed within the channel member 66. The sharp point 82 is to penetrate the supporting surface 22 with a portion of the stake 80 being below the level of ground 22.

The operation of the device of this invention is as follows: Form member 18 is placed in contact with the interior surface 32 and the pin 38 installed in position as shown in FIG. 2. The form member 20 is positioned against the interior surface 70 with the pin 76 then installed in position providing inside lateral support for the form member 20. The operator then loosens the fastener 58 and moves horizontal legs 30 and 62 relative to each other until the desired width between the form members 18 and 20 is obtained. At that time the fastener 58 is then tightened. Normally, every few feet or so there will be one of the devices shown in FIG. 4 installed with FIG. 1 showing five such devices. However, it is considered to be within the scope of this invention that the number of devices could be strictly a matter of choice along a longitudinal length of the form members 18 and 20.

One of the devices of this invention at one of the ends of the form members 18 and 20 is placed in this desired position with stakes 52 and 80 then being connected therewith and driven into the supportive surface 22. When the stakes 52 and 8 are so installed, the respective fasteners 50 and 68 are then tightened securing the respective stakes 52 and 80 in connection with the device. This procedure is then repeated for each of the devices along the entire length of the form members 18 and 20. The upper edge of form member 18 is to but against plug 34 with the upper edge of form member 20 abutting against plug 72.

When all of the devices have been so installed, slurry 16 is then poured between the form members 18 and 20. At this time the pins 38 and 76 are then moved from the extended position shown in FIG. 2 to the retracted position shown in FIG. 3 removing such from the slurry 16. The slurry 16 will automatically fill (with minor tapping or vibration) the voids left by the pins 38 and 76, and once the slurry 16 is hardened into the curb 10, the stakes 52 and 80 are to be disengaged from the supporting surface 22 and the device of this invention completely removed from the form members 18 and 20. After this, the form members 18 and 20 will also be removed. It is to be within the scope of this invention to make legs 28 or 64 outwardly angularly disposed if such is desired (as opposed to precisely vertical). In that instance, the corresponding surface of the curb 10 would be inclined.

I claim:

1. A curb form device to facilitate the constructing of a concrete curb, comprising a pair of elongated sheet material form members to be located in a spaced apart manner, said form members being located on a supporting surface;

a first rigid member, said first rigid member being substantially L-shaped forming a first vertical leg and a first horizontal leg;

a second rigid member, said second rigid member being L-shaped forming a second vertical leg and a second horizontal leg, said first and second vertical legs to rest on the supporting surface, said first vertical leg having a first exterior surface and a first interior surface, said second vertical leg having a second exterior and a second interior surface, said first interior surface facing said second interior surface with said first interior surface being spaced from said second interior surface forming a form area therebetween; means for connecting said first and second horizontal legs being connected together by connection means;

a first stake connected to said first vertical leg and located directly adjacent said first exterior surface, a second stake connected to said second vertical leg and located directly adjacent said second exterior surface, said first stake being movable relative to said first vertical leg and adapted to penetrate the supporting surface, said second stake being movable relative to said second vertical leg and adapted to penetrate the supporting surface;

a first lateral support pin connected to said first rigid member, said first lateral support pin being positioned directly adjacent to but spaced from said first interior surface when in a first extended position; and a second lateral support pin connected to said second rigid member, said lateral support pin being positioned directly adjacent to but spaced from said second interior surface when in a second extended position;

wherein one of said form members is to be located between said first lateral support pin and said first interior surface and the other form member is to be located between said second lateral support pin and said second interior surface with a slurry of concrete to be poured within said form area confined between said form members submerging a portion of both said first and second lateral support pins in the concrete, moving of said first and said second lateral support pins to first and second retracted positions prior to solidifying of the concrete with the slurry filling of the voids created due to removing of said first and said lateral support pins, after the concrete is solidified disengaging of said first and said second stakes from the supporting surface and separating of said concrete curb form device from the solidified concrete.

2. The curb form device as defined in claim 1 wherein:

said first lateral support pin being movable relative to said first rigid member between said first extended position and said first retracted position, said second lateral support pin being movable relative to said second rigid member between said second extended position and said second retracted position.

3. The curb form device as defined in claim 1 wherein:

said first interior surface being located parallel to said second interior surface.

4. The curb form device as defined in claim 1 wherein:

said connecting means being manually securable to fix in position said first and second horizontal legs.

5. The curb form device as defined in claim 1 wherein:

said first horizontal leg being adjustable relative to said second horizontal leg.

6. The curb form device as defined in claim 1 wherein:

said first stake being fixable to said first vertical leg, said second stake being fixable relative to said second vertical leg.

* * * * *